US007155929B2

(12) United States Patent
Lee et al.

(10) Patent No.: US 7,155,929 B2
(45) Date of Patent: Jan. 2, 2007

(54) PIPING STRUCTURE FOR AIR CONDITIONER

(75) Inventors: Jung Woo Lee, Seoul (KR); Sim Won Chin, Gwangmyeong-si (KR); In Hwa Jung, Seoul (KR); Kee Soo Hong, Anyang-si (KR); Moon Kee Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 36 days.

(21) Appl. No.: 10/750,872

(22) Filed: Jan. 5, 2004

(65) Prior Publication Data

US 2005/0050914 A1 Mar. 10, 2005

(30) Foreign Application Priority Data

Sep. 5, 2003 (KR) ..... 10-2003-0062109

(51) Int. Cl.
*F25B 39/04* (2006.01)
*F25D 19/00* (2006.01)

(52) U.S. Cl. ..... 62/507; 62/296; 62/498

(58) Field of Classification Search ..... 62/498, 62/507, 499, 295, 296, 298; 248/49, 638
See application file for complete search history.

(56) References Cited

FOREIGN PATENT DOCUMENTS

| | | | |
|---|---|---|---|
| JP | 55143343 A | | 11/1980 |
| JP | 03267637 A | * | 11/1991 |
| JP | 08327192 A | | 12/1996 |

* cited by examiner

*Primary Examiner*—Chen Wen Jiang
(74) *Attorney, Agent, or Firm*—Birch, Stewart, Kolasch, and Birch, LLP

(57) ABSTRACT

A piping structure of an air conditioner causes a looped main piping connected to a compressor of an outdoor unit of the air conditioner to be branched into two or more branch pipings within a predetermined interval of the main piping and cause the branch pipings to be jointed at an arbitrary location. According to the piping structure, it is possible to reduce a vibration by an interference phenomenon, which is generated when either a refrigerant pulsation or a periodic vibration of the compressor is divided and then combined.

17 Claims, 6 Drawing Sheets

PIPING STRUCTURE FOR AIR CONDITIONER

This Nonprovisional application claims priority under 35 U.S.C. § 119(a) on Patent Application No(s). 10-2003-0062109 filed in KOREA on Sept. 5, 2003, the entire contents of which are hereby incorporated by reference.

BACKGROUND OF THE INVENTION

1. Field of the Invention

The present invention relates to a piping structure for an air conditioner, and more particularly to a piping structure for an outdoor unit of an air conditioner, designed to minimize influence of a vibration from a compressor by changing a shape of pipings in a way that the pipings are branched and joined in the air conditioner with looped pipings.

2. Background of the Related Art

In general, a compressor refers to a machine used to compress a gaseous medium in various fields. The compressor used in the air conditioner where compression, condensation, expansion and evaporation are sequentially generated is used for compression.

FIG. 1 is a schematic view showing a conventional air conditioner.

Referring to FIG. 1, the conventional air conditioner includes an outdoor unit 10 disposed outdoors to make a heat exchange with outdoor air, an indoor unit 20 disposed indoors to condition indoor air, and a connection piping 30 for connecting the outdoor unit and the indoor unit.

To be more specific, the outdoor unit 10 is a means for transforming a gaseous refrigerant of low temperature and pressure, which is introduced from the indoor unit 20, into a liquid refrigerant while a heat exchange with outdoor air takes place. The outdoor unit 10 is composed of a compressor 11, a condenser 12 and an expansion valve 13.

Further, the compressor 11 is a member by which the gaseous refrigerant of low temperature and pressure which is introduced from the indoor unit 20 is transformed into a gaseous refrigerant of high temperature and pressure. The condenser 12 is a member by which the gaseous refrigerant of high temperature and pressure is transformed into a liquid refrigerant of intermediate temperature and high pressure. The expansion valve 13 is a member by which the liquid refrigerant of intermediate temperature and high pressure is transformed into a liquid refrigerant of low temperature and pressure.

Here, the condenser 12 is a member where a heat exchange with the outdoor air is directly made, and is provided with a separate fan 12*a* in order to attract the outdoor air.

Meanwhile, an evaporator 21 of the indoor unit 20, in which the liquid refrigerant of low temperature and pressure changed through the components of the outdoor unit 10 is transformed into the gaseous refrigerant of low temperature and pressure, causes the indoor temperature to be lowered by the evaporation heat at this time.

The indoor unit 20 includes the evaporator 21 by which the liquid refrigerant of low temperature and pressure is transformed into the gaseous refrigerant of low temperature and pressure, and a fan 21*a*. The connection piping 30 is a member for connecting the outdoor unit 10 and the indoor unit 20 so as to force the refrigerant to be circulated, and is appropriately disposed according to a distance between the outdoor unit 10 and the indoor unit 20.

By the way, there occurs a lot of vibration from the compressor 11 located at the outdoor unit 10 during compression. Such vibration is transmitted to other members via intake and discharge pipings which are connected to the compressor 11. The transmission of the vibration generated from the compressor 11 results in vibrating the whole air conditioner. Thus, it is necessary to take a measure to cope with this problem. As a result, it has been proposed to increase a length of the pipings by looping or to apply a lumped mass element to the pipings.

For instance, in another piping structure around the compressor according to the prior art, the pipings 152 and 153 (as shown in FIG. 2) connected to the compressor are looped, and then are provided with a separate lumped mass element 140. The gaseous refrigerant of low temperature and pressure introduced from the indoor unit (not shown) enters the outdoor unit through an external piping connected to a service valve 110, and then the gaseous refrigerant of low temperature and pressure introduced in this manner is subjected to removal of its liquid component by means of an accumulator 130, compression at the compressor 150, and conversion into the gaseous refrigerant of high temperature and pressure, and enters the condenser.

Meanwhile, the compressor 150 generates serious vibration during a compression process. This vibration is transmitted to other components of the air, conditioner via intake and discharge pipings 152 and 153 connected to the compressor 150. For this reason, it is necessary to regulate such vibration. In order to regulate transmission of the vibration, the pipings must be lengthened. This lengthening is solved by looping of the pipings, and additionally by mounting the lumped mass element 140 made of an elastic material such as a rubber to a desired location of the looped pipings. In general, the lumped mass element 140 is located at a lower end of the looped intake and discharge pipings 152 and 153 of the compressor 150.

Further, all the pipings connected to both the compressor 150 and the accumulator 130 pass through a reversing coil 120, and thereby the vibration is suppressed. Here, the reversing coil 120 is disposed in a rear upper space of the system so as not to interfere the intake and discharge pipings. Inlet and outlet of the reversing coil 120 are oriented downward.

Meanwhile, the looping of the intake piping 152 is adapted to linearly face upward by beginning with the accumulator 130 to be bent in a reverse U shape and then in an L shape at the reversing coil 120 in an upward direction. The looping of the discharge piping 153 is adapted to linearly face upward by beginning with a discharging part to be bent in a reverse U shape and then in an U shape along a base side again, and finally in an L shape at the reversing coil 120.

Further, a gaseous refrigerant tube 151 for transporting the gaseous refrigerant introduced into the compressor 150 is directly connected to the reversing coil 120 without any looping, and is also connected to the service valve 110 in consideration of connection with the external piping.

However, in the conventional piping structure around the compressor as mentioned above, the piping structure has a weak strength in an up and down direction as a whole. Further, in the case of application to an inverter air conditioner, the piping structure fails to actively cope with a wide range of specific frequency depending on operation condition of the air conditioner. Thus, this results in a problem in that energy of the vibration generated from the compressor and then transmitted to the whole outdoor unit can not be efficiently damped.

SUMMARY OF THE INVENTION

An object of the invention is to solve at least the above problems and/or disadvantages and to provide at least the advantages described hereinafter.

Accordingly, one object of the present invention is to solve the foregoing problems by providing a piping structure of an air conditioner, capable of actively coping with a wide range of specific frequency according to an operation condition (sleep/general/recover in an inverter air conditioner, of protecting components from a vibration and providing a sufficient life span to the components by efficiently damping the vibration transmitted from a compressor to a whole outdoor unit, and of increasing convenience of a consumer by decreasing a noise caused by the vibration.

Another object of the present invention to provide a piping structure of an air conditioner having an evaporator, a compressor and a condenser, comprising: a main piping connecting the evaporator, the compressor and the condenser to each other, wherein the main piping is branched into at least two branch pipings.

According to one aspect of the invention, the main piping is branched into at least two branch pipings at a predetermined location of the discharge and intake pipings, the branch pipings take a looped shape.

According to another aspect of the invention, the branch pipings are jointed again at a predetermined location.

The low-vibration piping structure according to the invention can remarkably damp the vibration transmitted from the compressor to the whole outdoor unit, and widen a change range of the specific frequency of the air conditioner.

Further, the low-vibration piping structure according to the invention can reduce the vibration by an interference phenomenon, which is generated when either a refrigerant pulsation or a periodic vibration of the compressor is divided and then combined.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The following detailed description will present a low-vibration piping structure of an air conditioner according to a preferred embodiment of the invention in reference to the accompanying drawings.

First, the piping structure of the air conditioner according to the invention will be schematically described.

In the air conditioner, compressor pipings of an outdoor unit are inevitably connected between a compressor and a chassis, thus transporting refrigerant and simultaneously transmitting a vibration of the compressor to the chassis. This is responsible for a structural noise.

In the case of a constant-speed type air conditioner, to reduce transmission of the vibration, the pipings are subjected to looping. Thereby, a specific frequency of the pipings is tuned, so that the transmission of the vibration generated originally is avoided at an operation frequency. However, in the case of an inverter air conditioner having a wide operation range, it is not easy to tune the specific frequency of the pipings so as not to have influence on the operation range as in the constant-speed type air conditioner.

However, in case where each piping is branched into two or more pipings, each of which has the same effective sectional area and is looped to cope with a vibration direction, it is possible not only to effectively damp the transmitted vibration but also to widen a change range of the specific frequency, due to a vibration damping effect caused by an interference phenomenon, which is generated when either a refrigerant pulsation or a periodic vibration of the compressor is divided and then combined.

Branching and/or jointing of each piping can be performed to at least one of discharge and intake pipings.

Further, a branching or jointing location of each piping may be appropriately selected according to a piping shape. Specifically, the branching may be performed at an arbitrary location or from the beginning. Of course, the same thing is true of the jointing.

Meanwhile, the effective sectional area refers to a sectional area through which the refrigerant passes, i.e., a sectional area of an internal passage of the piping. In case where each piping has the same effective sectional area, this is taken into one preferred example because a refrigeration cycle is not seriously changed. However, this is not essential because a desired effect is not accomplished under the condition of the same effective sectional area.

Figure 1:
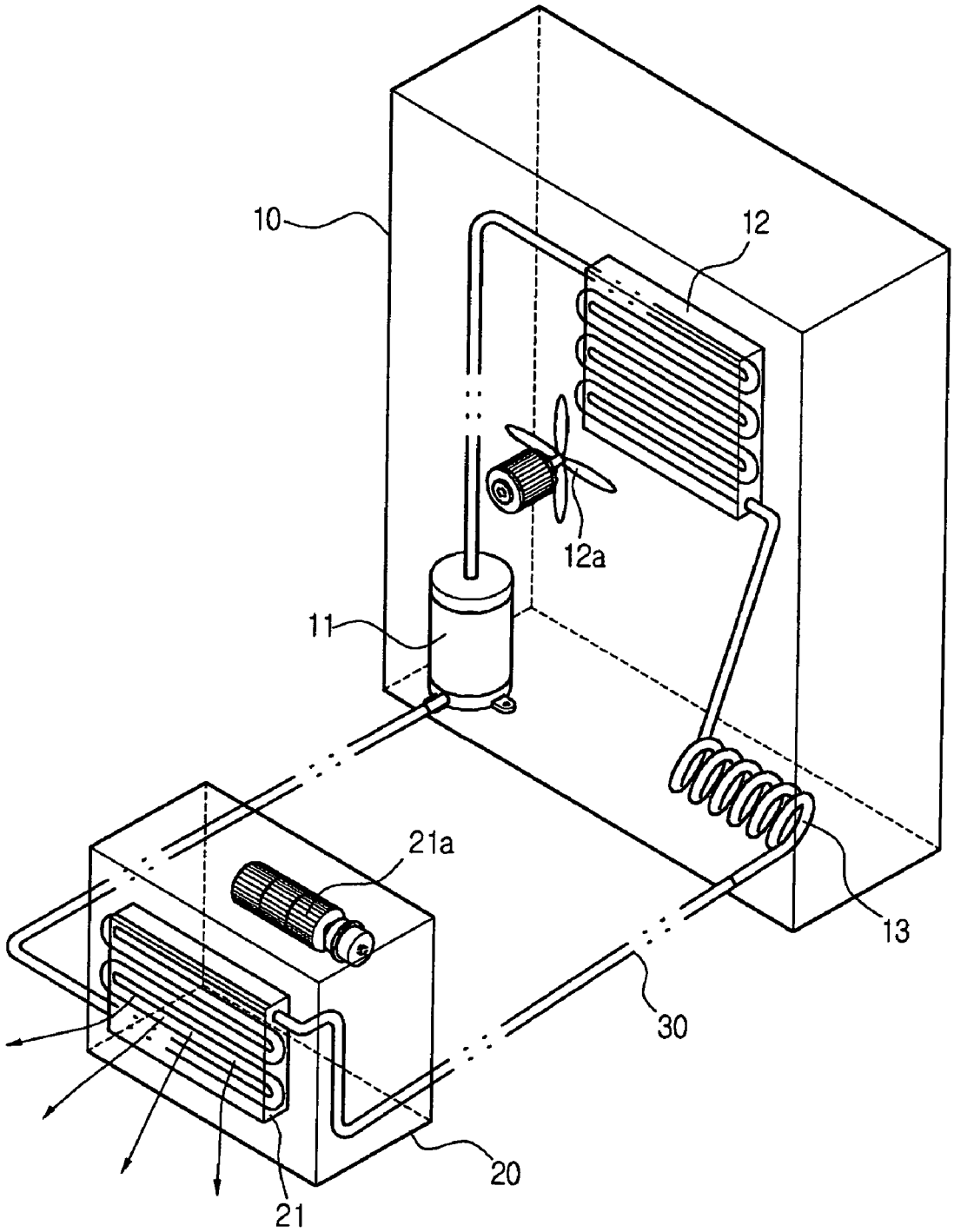
Fig.1 Related Art
FIG. 1 is a schematic view showing a conventional air conditioner.
Figure 2:
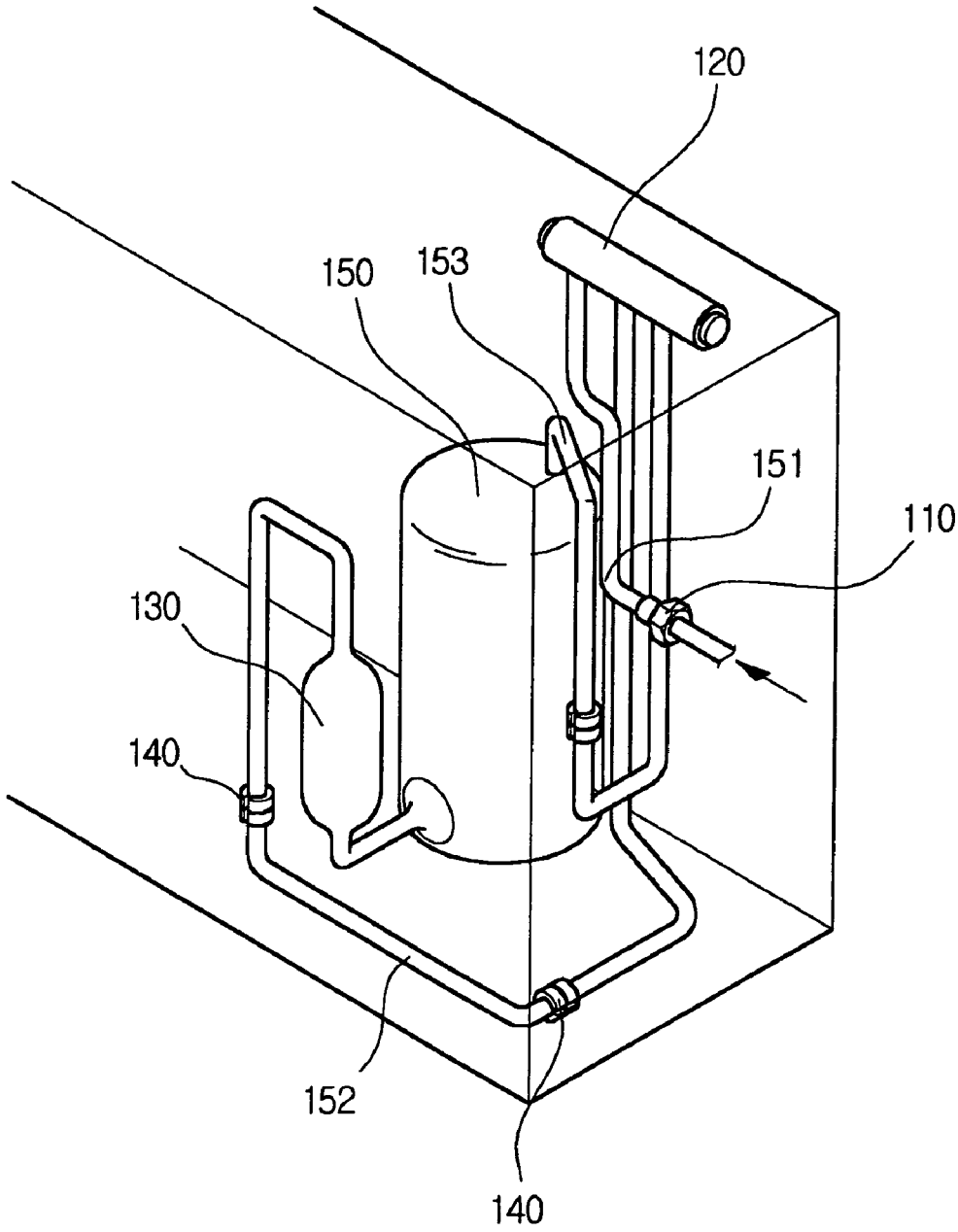
Fig.2 Related Art
FIG. 2 is a schematic view showing a piping-structure around a compressor according to the prior art.
Figure 3:
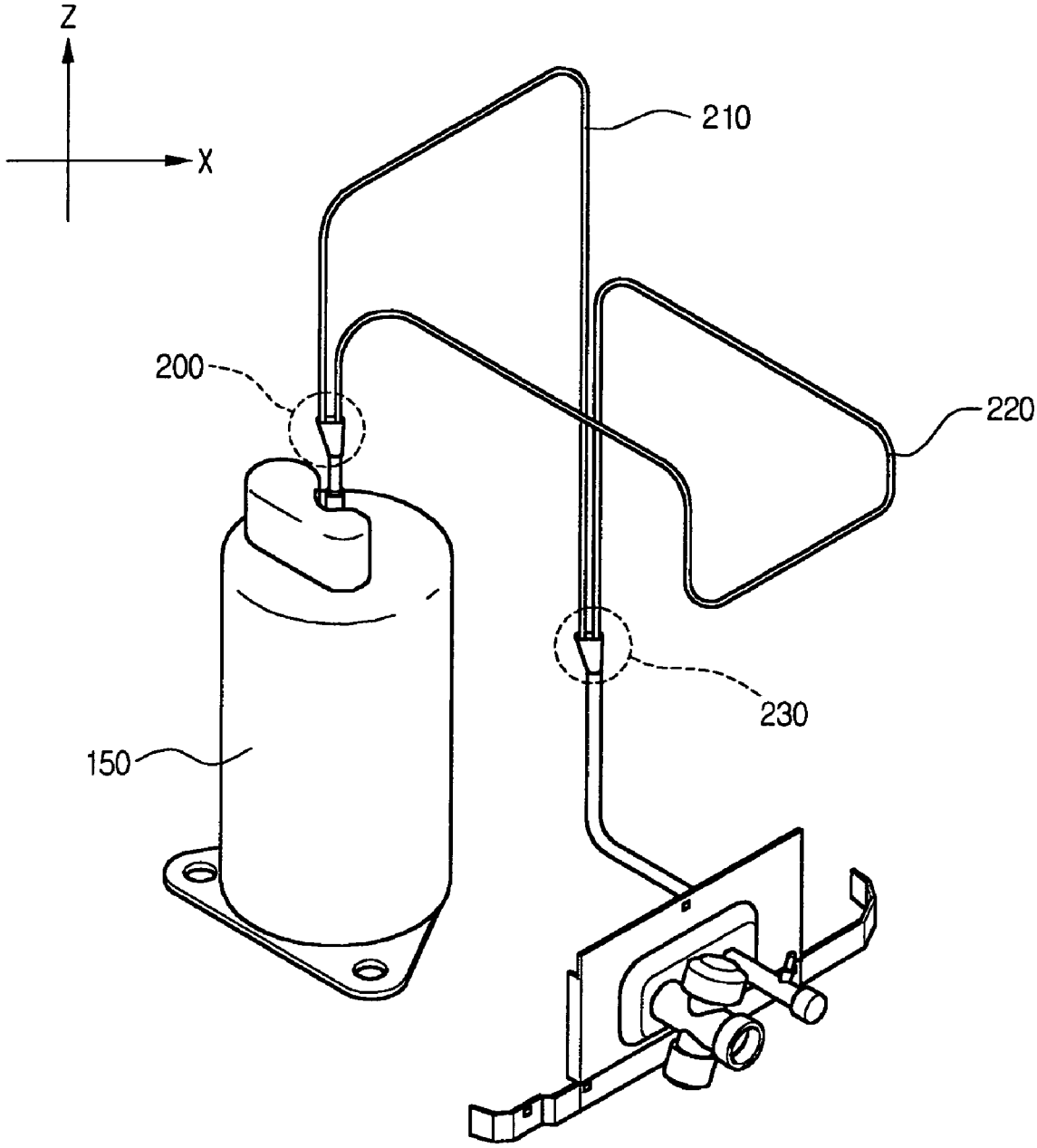
FIG. 3 shows a piping structure around a compressor of an outdoor unit of an air conditioner according to the invention.

FIG. 3 shows a piping structure around a compressor in an outdoor unit of an air conditioner m accordance with the invention.

Referring to FIG. 3, the low-vibration piping structure of the air conditioner according to the invention is characterized in that, in the piping structure having looped pipings connected to the outdoor unit of the air conditioner, a plurality of branch pipings are provided within a predetermined interval of the pipings so as to tune the specific frequency of the pipings around the compressor in the outdoor unit to cope with a wide operation range.

To be more specific, a plurality of pipings 210 and 220 surrounds the compressor 150 in the outdoor unit in connection with the compressor 150 so as for the vibration from the compressor to be transmitted to the whole outdoor unit. Particularly, the plurality of pipings 210 and 220 are formed as two or more branch pipings having the same effective sectional area within the predetermined interval of the looped pipings around the compressor 150.

Here, the plurality of branch pipings are preferably located on an XY plane, a YZ plane and a ZX plane respectively. Alternatively, at least one of the branch pipings may be located on two or more of the XY, YZ and ZX planes.

As one example, the first piping 210, which is branched at a branch part 200 as an arbitrary location of the discharge piping of FIG. 3, is looped to be perpendicular to a bottom surface, that is, is located on the YZ plane. The second piping 220 is looped to be perpendicular and parallel to the bottom surface, that is, is located on the XY and YZ planes.

In other words, each piping connected to the compressor 150 is branched at a predetermined location, for example, into a plurality of branch pipings 210 and 220, each of which is looped on the same plane at a predetermined angle with respect to the bottom surface, or takes a shape in which looped portions are interconnected on two or more planes.

As for the processes of generating the vibration from the outdoor unit having the low-vibration piping structure according to the invention and transmitting the vibration, when the air condition performs the compression process of the refrigeration cycle consisting of compression, condensation, expansion and evaporation processes, the vibration is generated from the compressor 150 by compression action. The vibration from the compressor 150 is transmitted to the main pipings connected to the compressor, and then to the plurality of branch pipings 210 and 220 connected within the predetermined interval of the main pipings.

Here, the first branch piping 210 takes a looped shape to be perpendicular to the bottom surface and is located on the YZ plane. The second piping 220 takes a looped shape to be perpendicular and parallel to the bottom surface and is located on the XY and YZ planes. Thus, the vibration transmitted from the compressor 150 passes through the first branch piping 210 in part and the second branch piping 220 in part. As a result, the vibration is damped at the looped branch pipings. The original vibration is removed for the most part, and the remaining vibration continues to be transmitted, and then is combined at a joint part 230 of the branch pipings 210 and 220. The remaining vibration transmitted along each branch piping is subjected to destructive interference at the joint part 230. Consequently, in this process, the vibration is considerably damped.

Further, in the low-vibration piping structure of the air conditioner according to the invention, the specific frequency is tuned according to the number of the branch pipings, the number of the planes on which the branch pipings are located, the total length of the branch pipings, so that it is possible to cope with the various specific frequencies of the air conditioner. Particularly, with regard to various characteristics of vibration caused by various types of operation of the compressor 150 according to various operation modes, such as sleep operation mode, general operation mode, recovery operation mode and so on, as in the inverter air conditioner, the piping structure according to the invention has an advantage in that it is possible to efficiently damp the vibration.

Meanwhile, as another embodiment of the invention, each branch piping may be configured to have a different length.

Figure 4:
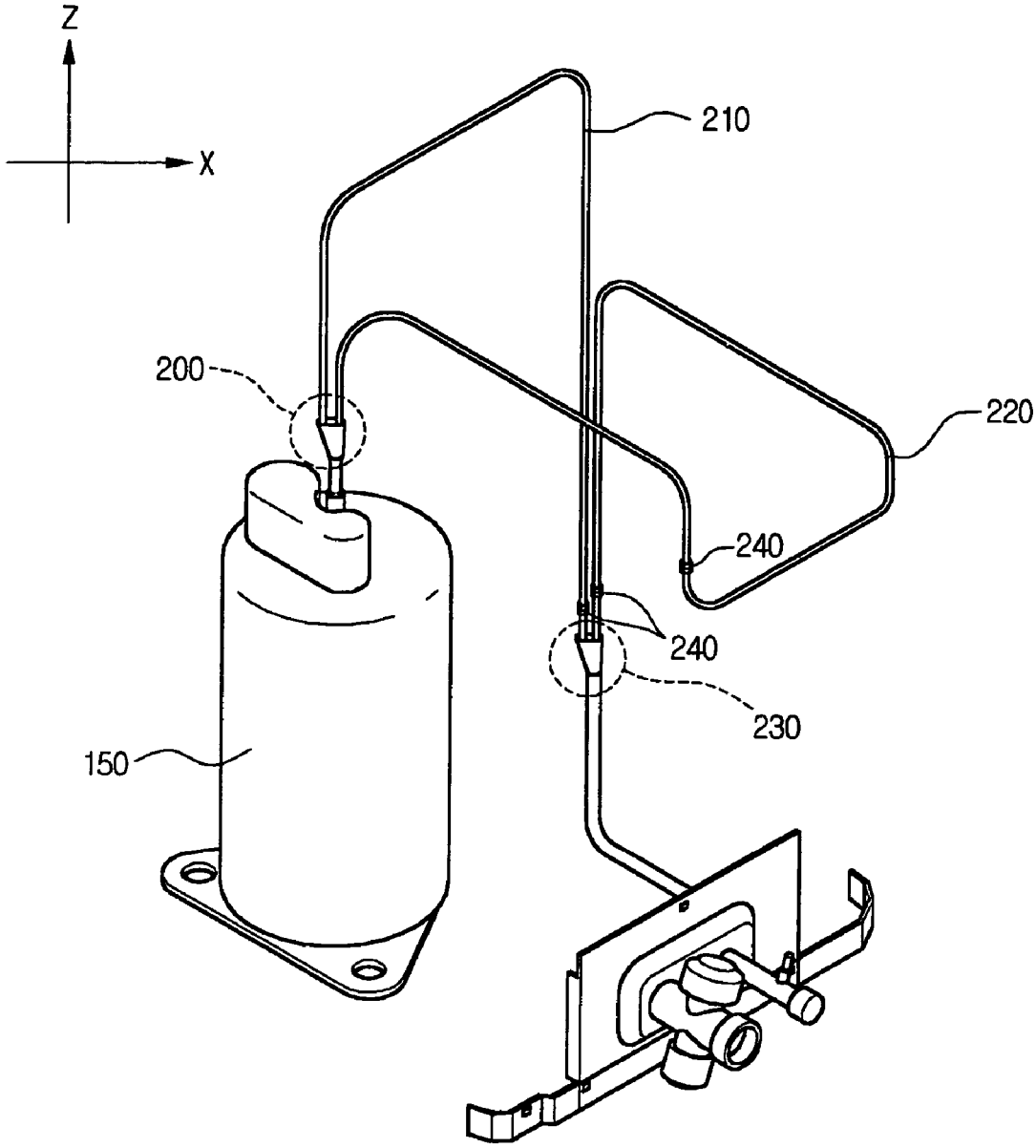
FIG. 4 shows a piping structure providing a lumped mass element at a predetermined location of a looped branch piping according to another embodiment of the invention.

For instance, as in FIG. 4, the looped branch piping may be provided with a lumped mass element 240 at a predetermined location.

To be specific, the lumped mass element 240 made of an elastic material such as a rubber is mounted at a desired location of the looped branch pipings. In general the lumped mass element 240 is located at a lower end of the looped intake and discharge pipings 152 and 153 of the compressor 150.

Figure 5:
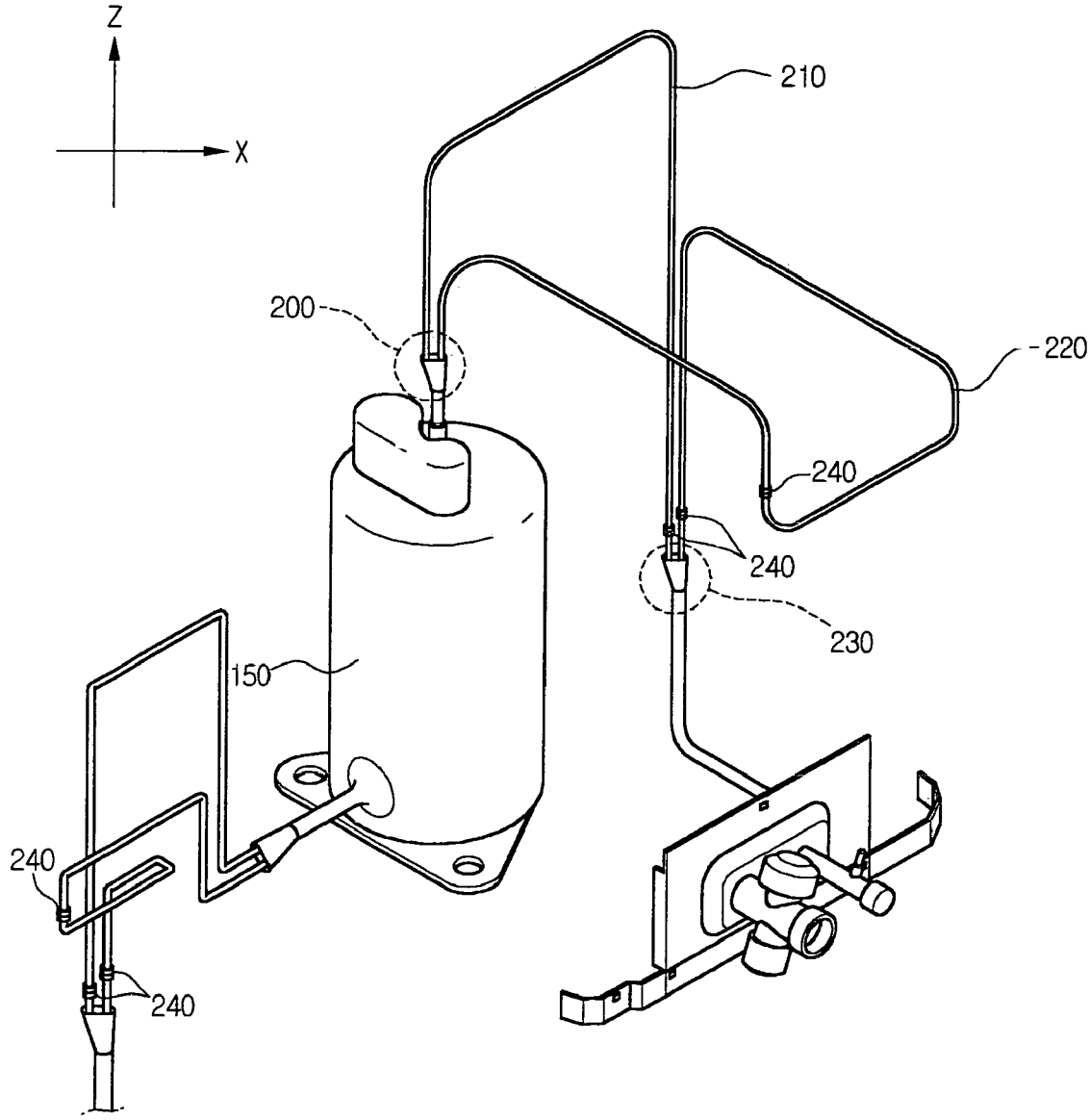
FIG. 5 shows a configuration that branching/jointing of a piping is performed to only an intake piping or both intake and discharge pipings and that the same thing is true of a lumped mass element according to yet another embodiment of the invention.

As yet another embodiment of the invention, as shown in FIG. 5, the branching/jointing of each main piping may be performed to only the intake piping or both the intake piping and the discharge piping. Further, the same thing may be true of the lumped mass element as mentioned above.

Figure 6:
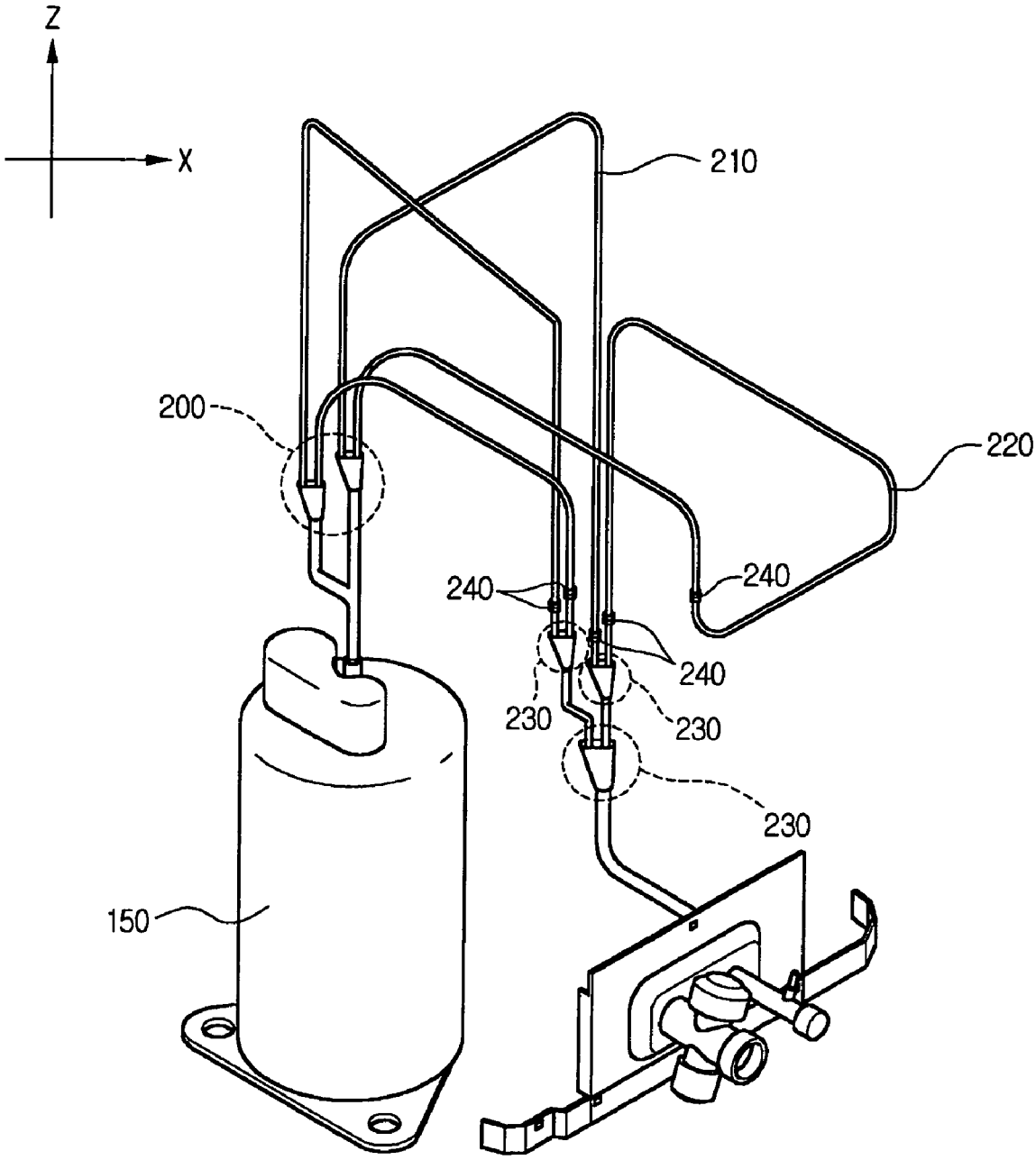
FIG. 6 shows a configuration that branching/jointing of a piping may be performed to have two or more branch parts and joint parts and that the two or more joint parts may be jointed again into a second joint part according to yet still another embodiment of the invention.

Further, as shown in FIG. 6, the branching/jointing of each main piping may be performed to have two or more branch parts and joint parts. The two or more joint parts may be jointed again into a second joint part.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A piping structure of an air conditioner having an evaporator, a compressor and a condenser, comprising:

a main piping connecting the evaporator, the compressor and the condenser to each other;

wherein the main piping is branched into at least two branch pipings at a first predetermined location near the compressor and the at least two branch pipings being looped, and the at least two branch pipings are jointed into at least one joint piping.

2. The piping structure according to claim 1, wherein the branch pipings are provided to at least one of discharge and intake pipings connected to the compressor.

3. The piping structure according to claim 1, wherein the branch pipings are jointed again at a second predetermined location away from the compressor.

4. The piping structure according to claim 1, wherein the branch pipings have a same effective sectional area.

5. The piping structure according to claim 1, wherein the main piping comprising at least two branch parts when the main piping is branched, and at least two joints parts.

6. The piping structure according to claim 5, wherein the joint parts are jointed into a second joint part.

7. The piping structure according to claim 1, wherein the branch pipings are bent differently from each other.

8. The piping structure according to claim 7, wherein the branch pipings are located on an XY plane, a YZ plane and a ZX plane, respectively.

9. The piping structure according to claim 7, wherein the branch pipings are located on at least two of an XY plane, a YZ plane and a ZX plane.

10. A piping structure of an air conditioner having an evaporator, a compressor and a condenser, comprising:

a main piping connecting the evaporator, the compressor and the condenser to each other;

wherein the main piping is branched into at least two branch pipings and the at least two branch pipings are jointed into at least one joint piping, and wherein the branch pipings are provided with a means for releasing a force generated during compression at a predetermined location.

11. The piping structure according to claim 10, wherein the means for releasing a force generated during compression is a lumped mass element of an elastic material, which is provided on a lower portion of at least one looped branch piping.

12. The piping structure according to claim 11, wherein the lumped mass element is provided at a lower end of at least one of the looped intake and discharge pipings of the compressor.

13. The piping structure according to claim 10, wherein the main piping comprises at least two branch parts when the main piping is branched, and at least two joint parts.

14. The piping structure according to claim 13, wherein the joint parts are joined at a second joint part.

15. The piping structure according to claim 10, wherein the branch pipings are bent differently from each other.

16. The piping structure according to claim 15, wherein the branch pipings are located on an XY plane, a YZ plane and a ZX plane, respectively.

17. The piping structure according to claim 15, wherein the branch pipings are located on at least two of an XY plane, a YZ plane and a ZX plane.

* * * * *